US011892269B2

(12) United States Patent
Fazillault et al.

(10) Patent No.: US 11,892,269 B2
(45) Date of Patent: Feb. 6, 2024

(54) UNDERWATER CRAFT COMPRISING MEANS FOR LAUNCHING AN UNDERWATER VEHICLE BY MEANS OF WATER PRESSURE

(71) Applicant: NAVAL GROUP, Paris (FR)

(72) Inventors: Vincent Fazillault, Ruelle-sur-Touvre (FR); Fabien Jagailloux, Ruelle-sur-Touvre (FR); Geoffrey Arrignon, Ruelle-sur-Touvre (FR); Arnaud Lamotte, Ruelle-sur-Touvre (FR)

(73) Assignee: NAVAL GROUP, Paris (FR)

( * ) Notice: Subject to any disclaimer, the term of this patent is extended or adjusted under 35 U.S.C. 154(b) by 154 days.

(21) Appl. No.: 17/611,059

(22) PCT Filed: May 13, 2020

(86) PCT No.: PCT/EP2020/063291
§ 371 (c)(1),
(2) Date: Nov. 12, 2021

(87) PCT Pub. No.: WO2020/229519
PCT Pub. Date: Nov. 19, 2020

(65) Prior Publication Data

US 2022/0260339 A1 Aug. 18, 2022

(30) Foreign Application Priority Data

May 15, 2019 (FR) ..... 1905050

(51) Int. Cl.
*F41F 3/10* (2006.01)

(52) U.S. Cl.
CPC ..... *F41F 3/10* (2013.01)

(58) Field of Classification Search
CPC ..... B63G 8/32; F41F 3/10
See application file for complete search history.

(56) References Cited

U.S. PATENT DOCUMENTS

| | | | | |
|---|---|---|---|---|
| 2,837,971 | A * | 6/1958 | Wosak | B63G 8/32 89/5 |
| 4,971,949 | A | 11/1990 | Laskaris et al. | |
| 2016/0372999 | A1 * | 12/2016 | Matsui | F41F 3/10 |

FOREIGN PATENT DOCUMENTS

| | | |
|---|---|---|
| EP | 0 151 980 A2 | 8/1985 |
| EP | 0 881 455 | 12/1998 |

(Continued)

OTHER PUBLICATIONS

International Search Report for PCT/EP2020/063291 dated Jul. 13, 2020, 4 pages.

(Continued)

*Primary Examiner* — Andrew Polay
(74) *Attorney, Agent, or Firm* — NIXON & VANDERHYE

(57) ABSTRACT

Underwater craft including means for launching an underwater vehicle using water pressure, including a vehicle-launching tube having a front part and a rear part and the rear part of which is connected to a water distribution tank itself connected to a water tube in which is positioned a piston for delivering water into the rear part of the tube in order to push and eject the vehicle, is characterized in that the piston is associated with a linear electric actuator for moving same.

8 Claims, 8 Drawing Sheets

(56) References Cited

FOREIGN PATENT DOCUMENTS

| | | |
|---|---|---|
| EP | 2 530 425 A1 | 12/2012 |
| EP | 3 106 825 | 6/2016 |

OTHER PUBLICATIONS

Written Opinion of the ISA for PCT/EP2020/063291 dated Jul. 13, 2020, 5 pages.

* cited by examiner

UNDERWATER CRAFT COMPRISING MEANS FOR LAUNCHING AN UNDERWATER VEHICLE BY MEANS OF WATER PRESSURE

This application is the U.S. national phase of International Application No. PCT/EP2020/063291, filed May 13, 2020 which designated the U.S. and claims priority to French Patent Application No. 1905050 filed May 15, 2019, the entire contents of each of which are hereby incorporated by reference.

BACKGROUND OF THE INVENTION

Field of the Invention

The present invention relates to an underwater craft, such as a submarine itself, comprising means for launching an underwater vehicle by means of water pressure.

Description of the Related Art

These means of launching, also known in the state of the art under the name of torpedo-launching tube or weapon-launching tube, for example, generally comprise an underwater vehicle launching tube associated with the means for ejecting it.

Different types of ejection means for this application are known in the state of the art.

As such, for example, there are vehicle-launching tubes associated with a pneumatic rammer.

In fact, this pneumatic rammer is positioned at the rear of the vehicle-launching tube and effectively comprises a telescopic piston including several stages, which pushes the weapon by mechanical contact at the rear of the latter to eject the weapon from the tube.

This pneumatic rammer is then associated with pneumatic means for its deployment and to hydraulic means for its re-deployment, for example.

A device similar to such a rammer can also be used for vehicle launching systems by means of water pressure.

In this case, the rear part of the weapon-launching tube is connected to a water distribution tank, itself connected to a water tube in which a piston is positioned, to push water into the rear part of the tube in order to push and eject the vehicle.

The piston is then set in motion by the rammer.

However, these different systems conceivably present a certain number of disadvantages in terms of the pneumatic and hydraulic constraints imposed by this type of rammer.

Other embodiments are given in document EP A 0 151 980, for example, which describes an ejection system by means of water pressure.

In EP A 2 530 425, the delivering device is a multi-stage telescopic piston, connected to a compressed air source via a launching valve.

In EP A 0 881 455, the delivering device is a pneumatic piston connected to a pressurized gas tank.

All these systems present several disadvantages, not only in terms of the constraints imposed but also in terms of the time required to implement the means of launching.

Launching with such means effectively requires a great number of manual operations.

Moreover, it is difficult or even impossible to control the ejection force of the underwater vehicle from the tube, for example, depending on the immersion of the underwater craft carrying it.

SUMMARY OF THE INVENTION

The object of the invention is therefore to solve these problems.

To this end, the invention has an underwater craft as its object, comprising means for launching an underwater vehicle by means of water pressure, of the type comprising a vehicle-launching tube having a front part and a rear part, the rear part of which is connected to a water distribution tank, itself connected to a water tube in which a piston is positioned for delivering water into the rear part of the tube in order to push and eject the vehicle, characterized in that the piston is associated with means forming a linear electric actuator for moving it.

According to other features of the device according to the invention, taken alone or in combination:

- the linear electric actuator means comprise at least two telescopic actuator stages deployable one beyond the other;
- at least two vehicle-launching tubes are associated with the water distribution tank and comprise means for isolating/connecting the tube to the tank;
- it comprises means for controlling the electrical supply to the actuator means in order to control the ejection characteristics of the underwater vehicle;
- it comprises means for controlling the power supply to the means forming the actuator to control the deceleration and stopping of the piston and/or the acoustic signature of a launch.

BRIEF DESCRIPTION OF THE DRAWINGS

The invention will be better understood from the following description, given only by way of example and made with reference to the appended drawings in which.

DESCRIPTION OF THE PREFERRED EMBODIMENTS

Figure 1:
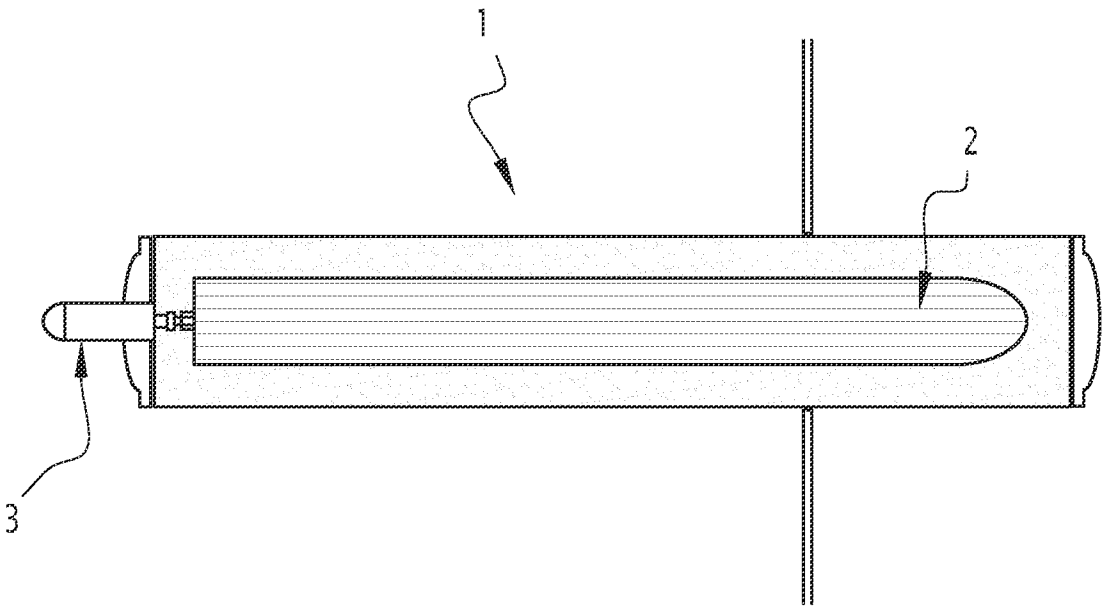
FIGS. 1 and 2 illustrate the structure and operation of an ejection system pneumatic rammer of the prior art.
Figure 2:
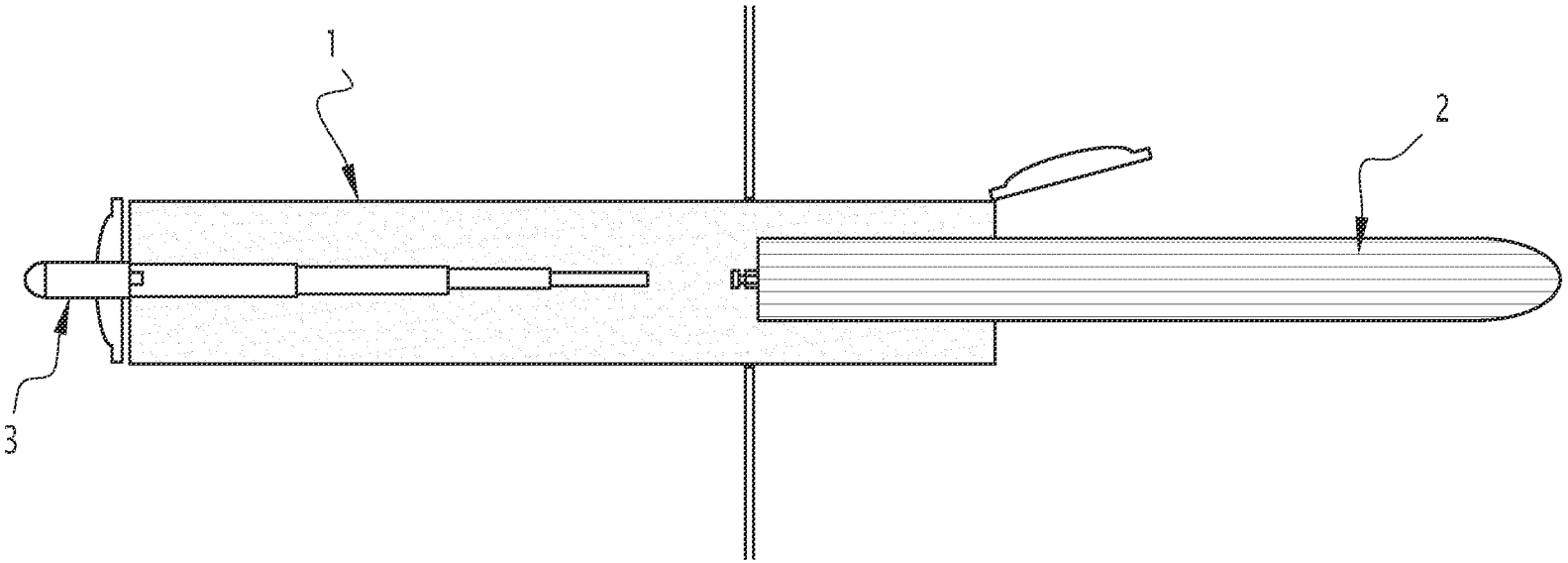

FIGS. 1 and 2 illustrate the structure and operation of a vehicle-launching tube such as a weapon-launching or torpedo-launching tube of an underwater craft, for example, such as a submarine, using a pneumatic rammer.

In these FIGS. 1 and 2, the vehicle-launching tube is designated by the general reference 1, the vehicle to be launched by the general reference 2 and the rammer by the general reference 3.

In fact, and as previously indicated, this rammer is a telescopic piston comprising several stages that eject the weapon by pushing it into the rear of the tube.

This piston is associated with pneumatic and hydraulic actuators, for example, as described previously.

Figure 3:
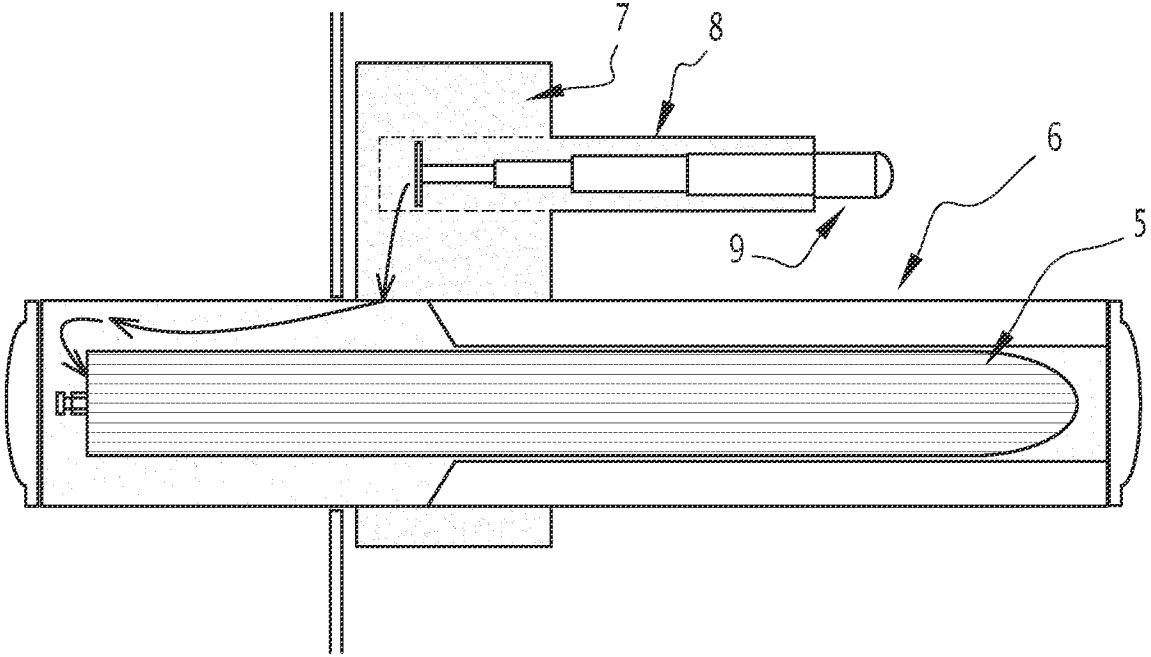
FIG. 3 illustrates the structure and operation of a water push ejection system by means of water pressure, of the prior art.

FIG. 3 illustrates the principle of ejection using a water pressure.

In this FIG. 3, the vehicle to be launched is designated by the general reference 5 and this vehicle is positioned in a vehicle-launching tube, designated by the general reference 6.

This tube 6 has a front portion and a rear portion.

The rear portion of the tube 6 is connected to a water distribution tank, designated by general reference 7, which in turn is connected to a water tube 8, in which a piston 9 is positioned for discharging water into the rear portion of the tube 6 in order to push and eject the vehicle.

In the examplary embodiment shown in this FIG. 3, this piston is a telescopic piston, for example, with several stages and which can then be associated with pneumatic and hydraulic services as described above.

As previously mentioned, these different systems have a number of drawbacks.

To solve these problems, in the underwater device according to the invention it is proposed that the piston be associated with the linear electric actuator means for moving it.

Figure 4:
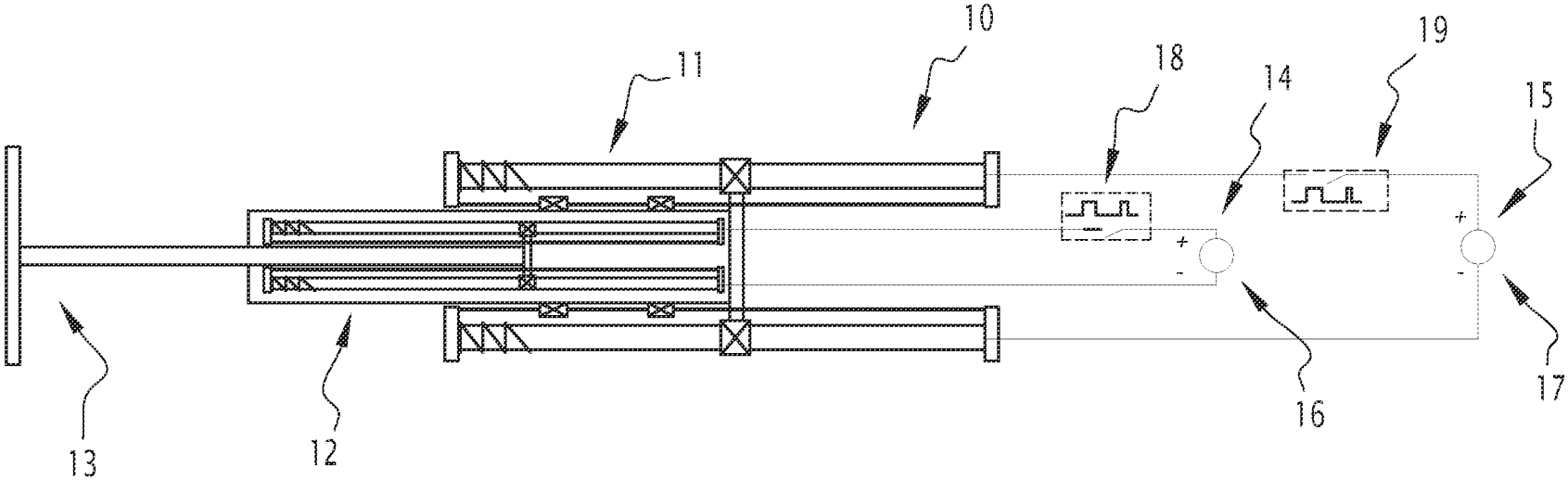
FIG. 4 illustrates the general structure of the means forming a linear electric actuator used in the construction of an underwater craft according to the invention.
Figure 5:
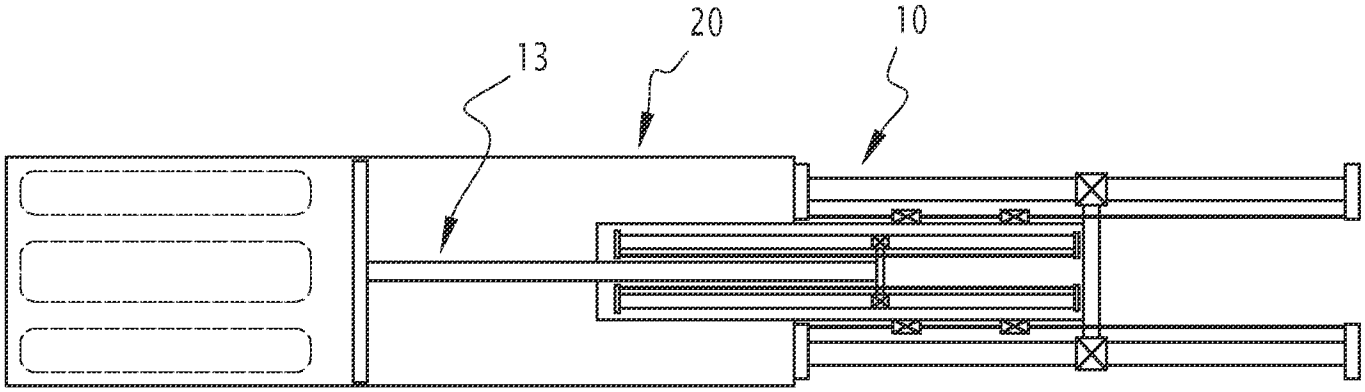
FIG. 5 illustrates the implementation of such actuator means in a water tube.
Figure 6:
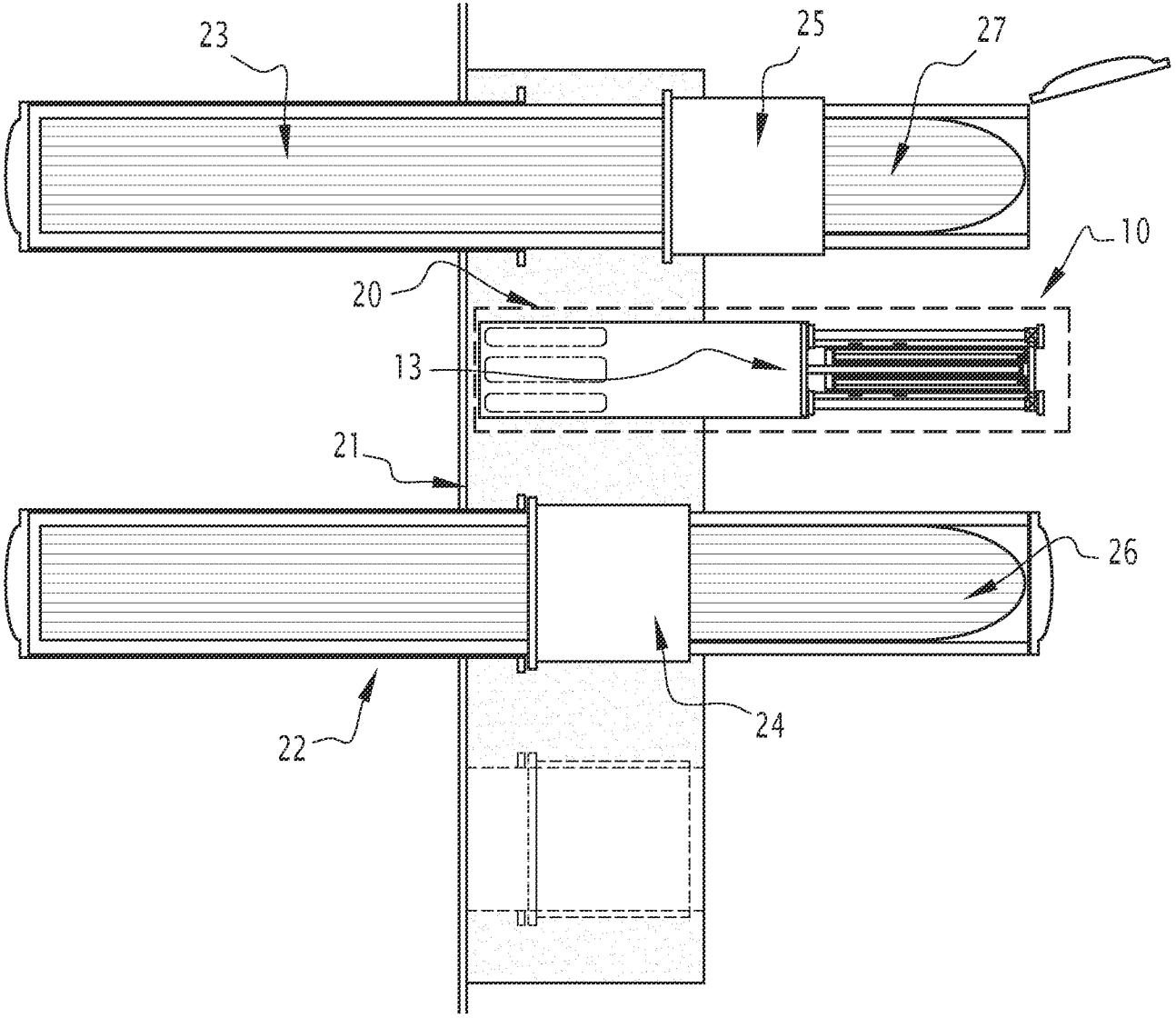
FIGS. 6, 7 and 8 illustrate the operation of a vehicle-launching tube of an underwater craft equipped with such actuator means.
Figure 7:
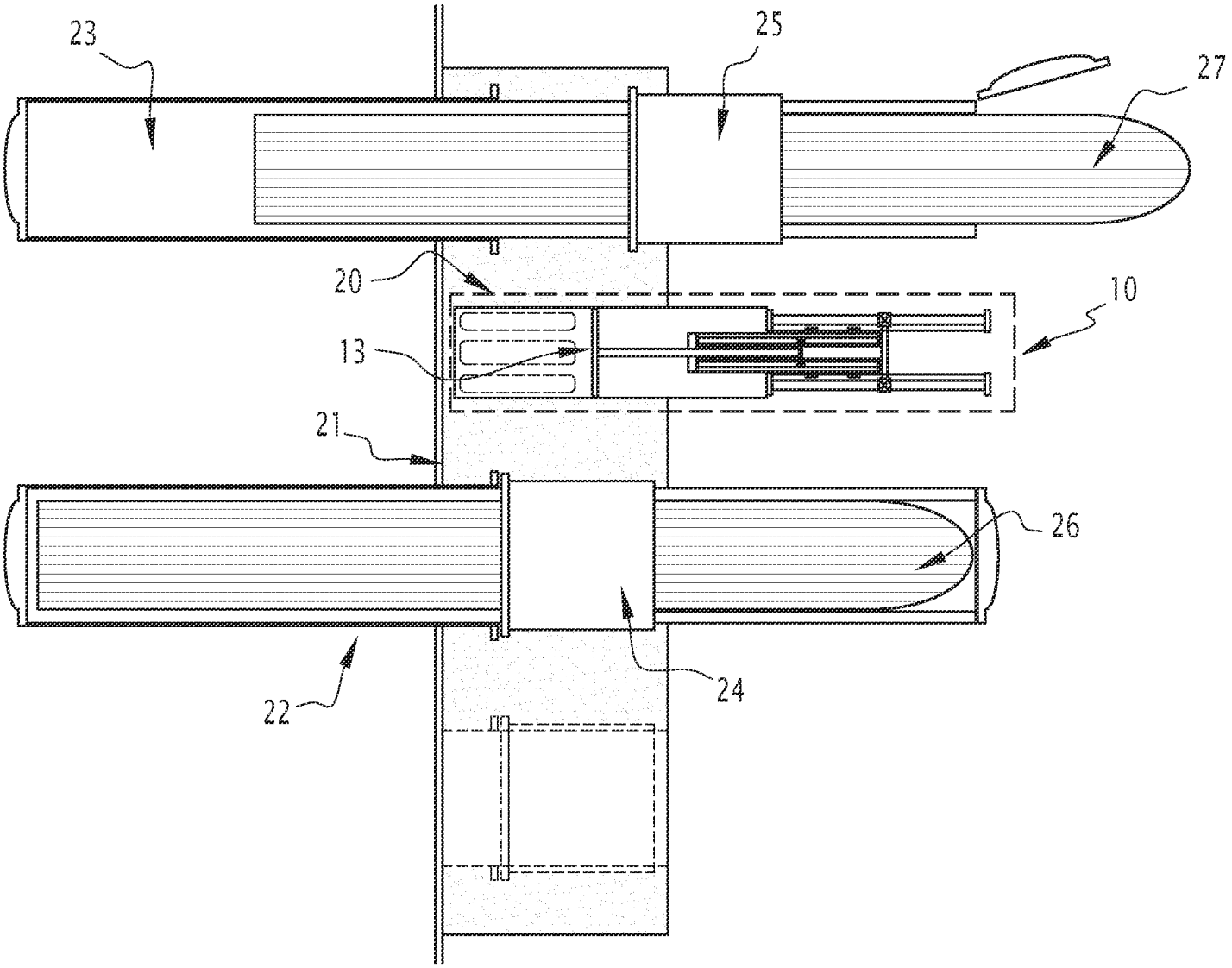
Figure 8:
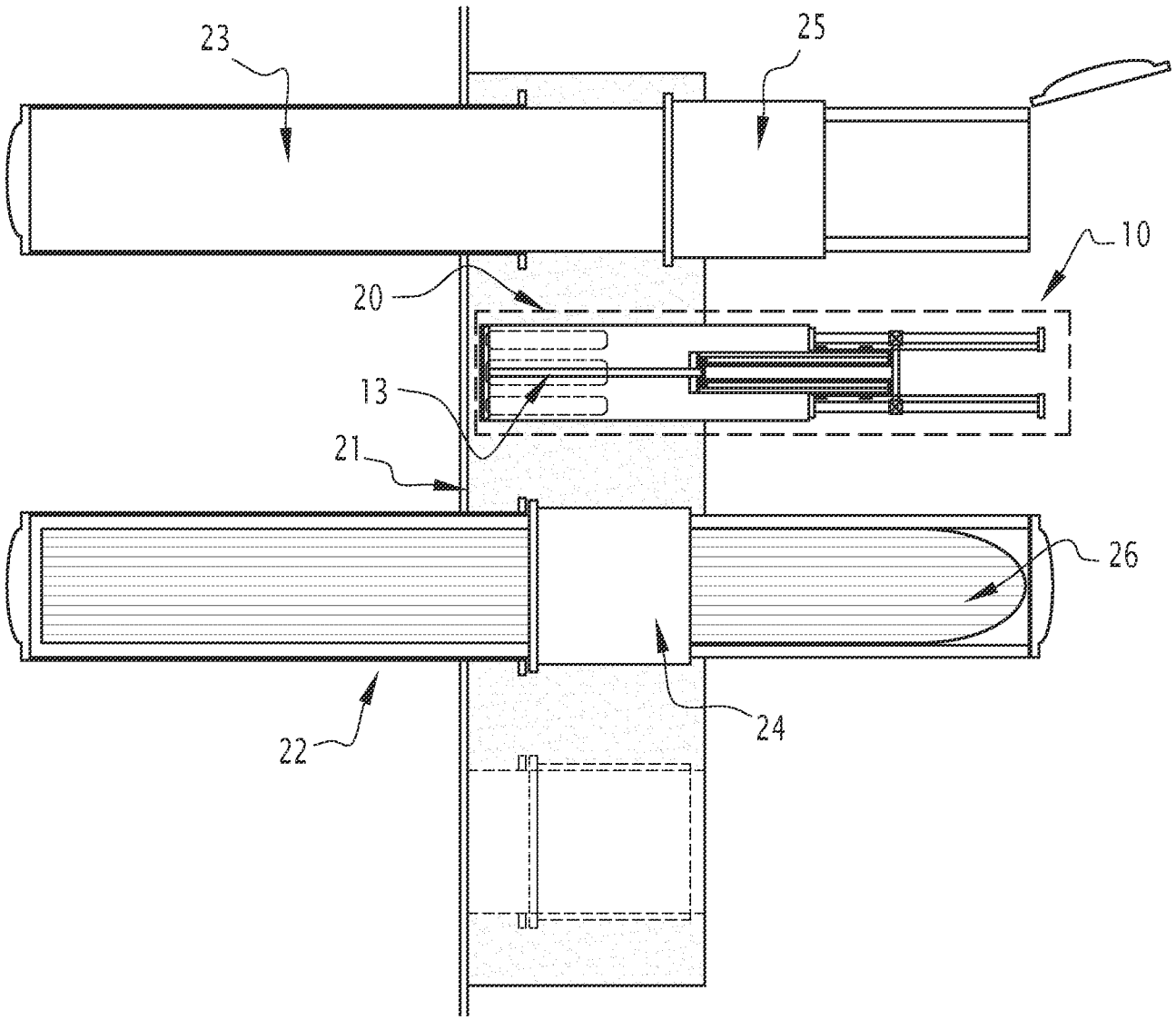

An examplary embodiment of such electric actuator means is illustrated in FIG. 4.

In this FIG. 4, the linear electric actuator is designated by the general reference 10.

In fact, this actuator comprises at least two telescopic actuator stages, for example, deployable one beyond the other upon activation, as shown.

These actuator stages are designated by the general references 11 and 12 in these Figures, for example.

As for the piston, it is designated by the general reference 13 in this FIG. 4.

In fact and as illustrated, each stage of the electric actuator can be associated with its own power supply means, such as the means designated by the general references 14 and 15 in these Figures.

These means then comprise an electrical power source designated by the general references 16 and 17, for example, and each stage is associated with electronic control power means, designated by the general references 18 and 19.

These means then make it possible to drive the electrical power supply to these actuator means and to each stage thereof, for example, to control the ejection characteristics of the underwater vehicle.

These means also make it possible to control the power supply to the actuator and its stages, to control the deceleration and stopping of the piston and/or the acoustic signature of a vehicle launch.

Indeed, the control means can use the means in the form of a chopper, for example, making it possible to modulate the power supply to the actuator stages and thus the speed and launching force of the underwater vehicle depending on various parameters such as the immersion, for example, or even the speed of movement of the underwater vehicle carrier, the type of launch desired for the vehicle, etc.

Such means forming a linear electric actuator can then be integrated into a system for launching an underwater craft, by means of water pressure, from an underwater craft such as a submarine itself, as illustrated in FIGS. 5, 6, 7 and 8.

In these FIGS. 5 through 8, the linear electric actuator means is always referred to by the general reference 10 and the piston by the general reference 13.

Indeed, the piston 13 may be positioned in a water tube designated by general reference 20, connected to a water distribution tank 21, which in turn is connected to the rear portion of one or more vehicle-launching tubes of the underwater craft such as the tubes designated by general references 22 and 23 in these Figures.

A side door such as 24 and 25 or other means then makes it possible to isolate or, conversely, to connect the weapon-launching tube corresponding to the tank 21, in order to make it possible to launch a submarine vehicle such as a torpedo or the like, for example, designated by the references 26 and 27 in these Figures, from this launching tube.

Several vehicle-launching tubes of the underwater craft may conceivably be associated with the tank 21 through such isolation/connection means.

When the electric linear actuator means 10 is activated, it then conceivably deploys and pushes the piston 13 into the water tube 20, thereby forcing a corresponding water volume into the rear portion of the vehicle launch tube through the tank 21, thereby ejecting the vehicle from the corresponding tube.

Such a structure then conceivably presents a certain number of advantages in terms of the ease of launch implementation, and the discretion thereof while making it possible to be free of the constraints of the pneumatic and hydraulic systems of the state of the art.

Of course, other embodiments can be envisaged.

The invention claimed is:

1. An underwater craft comprising means for launching an underwater vehicle by means of water pressure, comprising a vehicle-launching tube having a front part and a rear part, the rear part of which is connected to a water distribution tank, itself connected to a water tube in which a piston is positioned, for delivering water into the rear part of the tube, in order to push and eject the vehicle, wherein the piston is associated with means forming a linear electric actuator for moving same, and wherein the linear electric actuator means comprises at least two telescopic actuator stages deployable beyond each other.

2. The underwater craft according to claim 1, wherein at least two vehicle-launching tubes are associated with the water distribution tank and comprise means for isolating/connecting the tube to the tank.

3. The underwater craft according to claim 1, further comprising means for controlling the electrical supply to the actuator means for controlling the ejection features of the underwater vehicle.

4. The underwater craft according to claim 1, further comprising means for controlling the electrical supply to the means forming an actuator, to control the deceleration and stopping of the piston and/or the acoustic signature of a launch.

5. The underwater craft according to claim 2, further comprising means for controlling the electrical supply to the actuator means for controlling the ejection features of the underwater vehicle.

6. The underwater craft according to claim 2, further comprising means for controlling the electrical supply to the means forming an actuator, to control the deceleration and stopping of the piston and/or the acoustic signature of a launch.

7. The underwater craft according to claim 3, further comprising means for controlling the electrical supply to the means forming an actuator, to control the deceleration and stopping of the piston and/or the acoustic signature of a launch.

8. The underwater craft according to claim 5, further comprising means for controlling the electrical supply to the means forming an actuator, to control the deceleration and stopping of the piston and/or the acoustic signature of a launch.

* * * * *